US011653760B2

(12) United States Patent
Duggins

(10) Patent No.: US 11,653,760 B2
(45) Date of Patent: May 23, 2023

(54) BRACKET FOR DRAWER SLIDE

(71) Applicant: Tenn-Tex Plastics, Inc., Colfax, NC (US)

(72) Inventor: William Duggins, Kernersville, NC (US)

(73) Assignee: Tenn-Tex Plastics, Inc., Colfax, NC (US)

( * ) Notice: Subject to any disclaimer, the term of this patent is extended or adjusted under 35 U.S.C. 154(b) by 164 days.

(21) Appl. No.: 17/202,872

(22) Filed: Mar. 16, 2021

(65) Prior Publication Data

US 2021/0321766 A1 Oct. 21, 2021

Related U.S. Application Data

(60) Provisional application No. 63/011,773, filed on Apr. 17, 2020.

(51) Int. Cl.
*A47B 88/43* (2017.01)
*A47B 88/407* (2017.01)

(52) U.S. Cl.
CPC ..... *A47B 88/43* (2017.01); *A47B 88/407* (2017.01)

(58) Field of Classification Search
CPC ..... A47B 88/43; A47B 88/407
See application file for complete search history.

(56) References Cited

U.S. PATENT DOCUMENTS

| | | | | |
|---|---|---|---|---|
| 6,854,817 | B1 | 2/2005 | Simon | |
| 8,911,037 | B2 | 12/2014 | Hightower | |
| 9,549,613 | B2 * | 1/2017 | Hightower | A47B 88/43 |
| 11,375,810 | B2 * | 7/2022 | Chen | A47B 88/423 |
| 2011/0234072 | A1 * | 9/2011 | Hightower | A47B 88/43 312/334.8 |
| 2012/0145845 | A1 * | 6/2012 | Hightower | A47B 88/423 248/223.41 |
| 2015/0082597 | A1 * | 3/2015 | Hightower | A47B 88/423 29/408 |
| 2021/0345774 | A1 * | 11/2021 | Duggins | A47B 88/43 |

* cited by examiner

*Primary Examiner* — Anita M King
(74) *Attorney, Agent, or Firm* — Myers Bigel, P.A.

(57) ABSTRACT

An undermount slide bracket includes: a panel with upper and lower edges; a nub extending from a first side of the panel; a shelf extending from a second, opposed side of the panel; a lower panel extending downwardly from the shelf; a plurality of pairs of wings extending from the lower panel, the pairs of wings being arranged in stacked, spaced apart relationship, such that a gap is formed between adjacent pairs of wings; and a stop located in the gap between the wings.

18 Claims, 5 Drawing Sheets

BRACKET FOR DRAWER SLIDE

RELATED APPLICATION

The present application claims priority from and the benefit of U.S. Provisional Patent Application No. 63/011,773, filed Apr. 17, 2020, the disclosure of which is hereby incorporated herein by reference in full.

FIELD OF THE INVENTION

The present invention is directed generally to furniture, and more particularly to cabinets with sliding drawers and trays.

BACKGROUND OF THE INVENTION

Many cabinets, particularly those found in kitchens, include drawers for storing various items. Often, drawers are mounted to the cabinet with elongate drawer slides that are fixed to the drawer. Each drawer slide has a slide member fixed to the drawer that slidably engages a stationary member that is fixed to the walls of the cabinet (often either the slide member or the stationary member includes a small wheel that facilitates sliding motion). Some of such cabinets include multiple drawers, which can be disposed in vertically stacked fashion, side-by-side fashion, or both.

Some drawers have slides that are mounted on the underside of the drawer (so-called "undermounted" drawer slides). These drawer slides may be preferred in some environments because they are less exposed than side-mounted drawer slides (and therefore may be less exposed to damage) and may avoid taking up space on either side of the drawer. In some embodiments, undermounted slides may have mechanisms that cause the drawer to close automatically without slamming. An exemplary undermounted drawer slide is the DYNAMIC NT slide, available from Mepla-Alfit, Reinheim, Germany; another is illustrated in U.S. Pat. No. 6,854,817 to Simon.

An undermounted drawer slide may be mounted to a side wall of the cabinet, or may be mounted at either end to the front or rear wall. If the slide is to be mounted to the front or rear wall, often the wall will include mounting holes for receiving screws or other fasteners inserted through a mounting bracket that connects to the slide. However, the tolerances of cabinets and drawer slides are typically insufficiently precise to consistently position the holes in the mounting bracket for easy mounting of the drawer slide. Also, some currently popular cabinets have drawers that are configured such that, when the drawer is closed, the front face of the drawer is substantially flush with the front face of the cabinet. In such instances, it is typically desirable that the drawer be mounted precisely to ensure the flush relationship of the drawer face and cabinet face. However, achieving a flush relationship may be difficult due to inconsistencies in the thickness of the drawer face, the length of the cabinet and drawer slides, and the thickness of the front wall of the cabinet. Examples of systems that can help to address these issues are shown in U.S. Pat. No. 8,911,037, the disclosure of which is hereby incorporated herein in full by reference.

In view of the foregoing, it may be desirable to provide improved components that expand on this mounting technique.

SUMMARY

As a first aspect, embodiments of the invention are directed to an undermount slide bracket. The bracket comprises: a panel with upper and lower edges; a nub extending from a first side of the panel; a shelf extending from a second, opposed side of the panel; a lower panel extending downwardly from the shelf; a plurality of pairs of wings extending from the lower panel, the pairs of wings being arranged in stacked, spaced apart relationship, such that a gap is formed between adjacent pairs of wings; and a stop located in the gap between the wings.

As a second aspect, embodiments of the invention are directed to a bracket assembly for mounting a drawer slide in a cabinet comprising the undermount slide bracket described above and a mounting bracket. The mounting bracket comprises: a main panel having front and rear surfaces, upper and lower edges, and opposed side edges; an L-shaped upper flange mounted to front surface of the main panel; an L-shaped lower flange mounted to the front surface of the main panel substantially parallel to the upper flange; a recess in the main panel positioned between the upper flange and the lower flange; and means for mounting the main panel to the cabinet wall so that the rear surface confronts the rear wall. The upper edge of the undermount slide bracket panel is captured by the upper flange, the lower edge of the mating bracket panel is captured by the lower flange, and the nub is received in the recess. The recess and nub are configured such that the nub is free to translate horizontally within the recess relative to the main panel, such that the position of the mating bracket relative to the mounting bracket can be adjusted horizontally.

DETAILED DESCRIPTION

Figure 1:
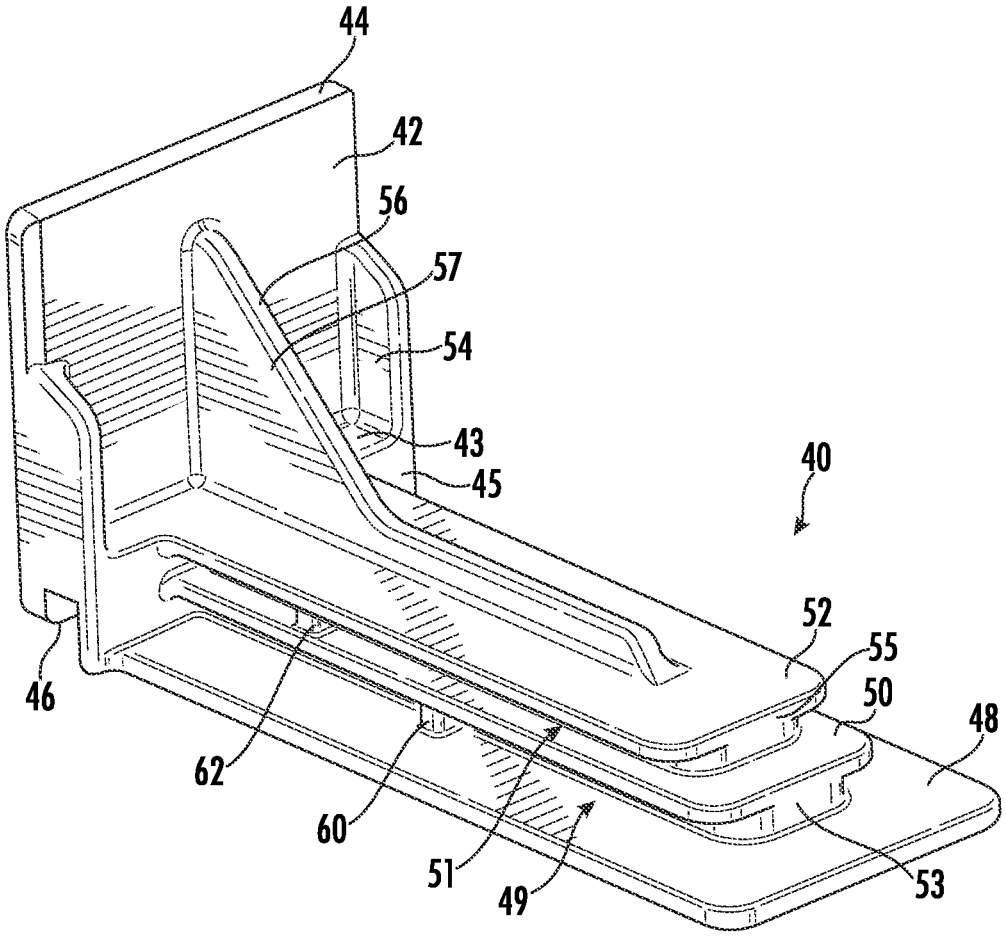
FIG. 1 is a perspective view of an undercount slide bracket useful in mounting drawer slides in cabinets according to embodiments of the invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

Referring now to the drawings, an undermount slide bracket, designated broadly at 40, is shown in FIGS. 1-4. The undermount slide bracket 40 has a vertical panel 42 that extends downwardly to a shelf 43. The shelf 43 extends forwardly to a lower panel 45. The vertical panel 42 includes an upper edge 44 and a lower edge 46. A rear nub 58 extends from the rear surface of the vertical panel 42.

Three sets of wings (lower wings 48, intermediate wings 50, and upper wings 52) extend forwardly from the lower panel 45. The lower wings 48 extend forwardly from the lower edge of the lower panel 45, and the upper wings 52 extend forwardly from the shelf 43. The wings 48, 50, 52 are "stair-stepped", such that the intermediate wings 50 extend forwardly slightly farther than do the upper wings 52, and the lower wings 48 extend forwardly slightly farther than do the intermediate wings 50. The strata of wings 48, 50, 52 are separated from each other by foundations 53, 55, which create gaps 49, 51 between respective pairs of wings 48, 50, 52. It can also be seen in FIG. 3 that the intermediate and upper wings 50, 52 are narrower in width than the lower wings 48.

Reinforcing ribs 54 extend forwardly from the lateral edges of the vertical panel 42 and merge with the edges of the shelf 43. A central rib 56 divides the wings 48, 50, 52 and extends upwardly from the upper wings 52. The rib 56 includes a triangular gusset 57 that extends rearwardly to the front surface of the vertical panel 42, although in other embodiments the gusset may extend farther forwardly, or may be omitted entirely.

Figure 2:
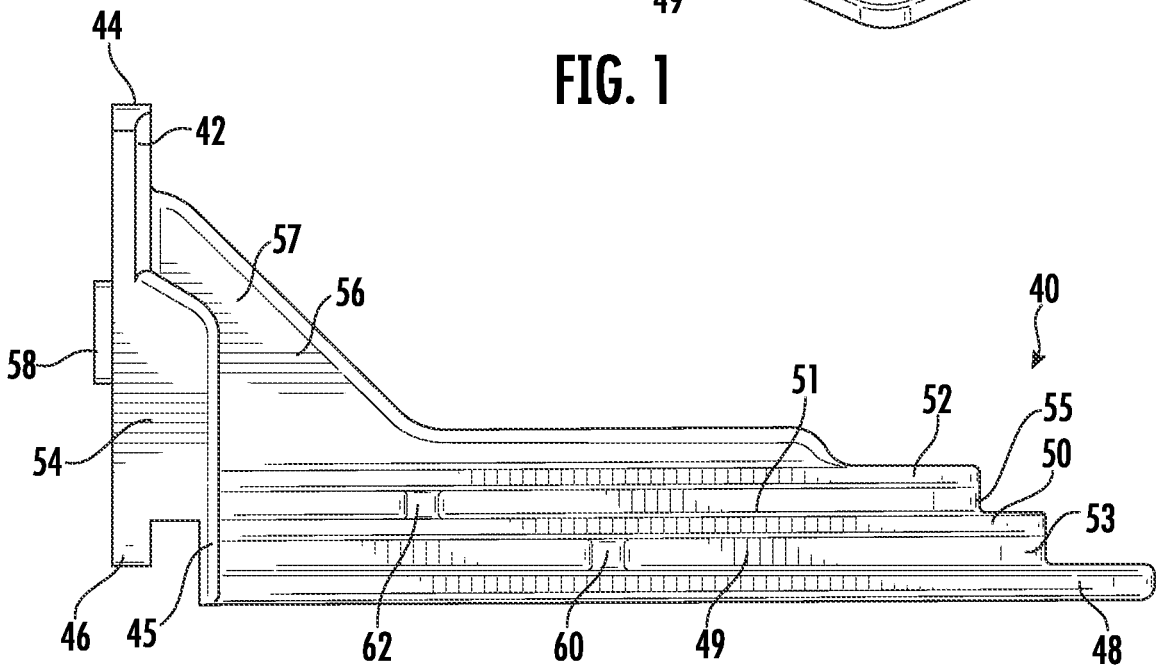
FIG. 2 is a side view of the bracket of FIG. 1.
Figure 3:
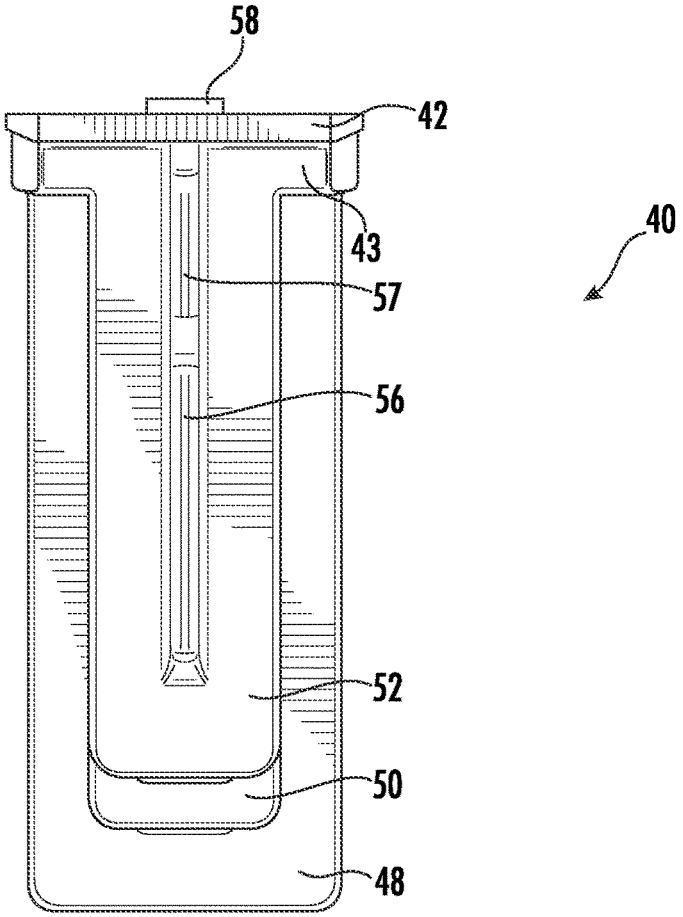
FIG. 3 is a top view of the bracket of FIG. 1.
Figure 4:
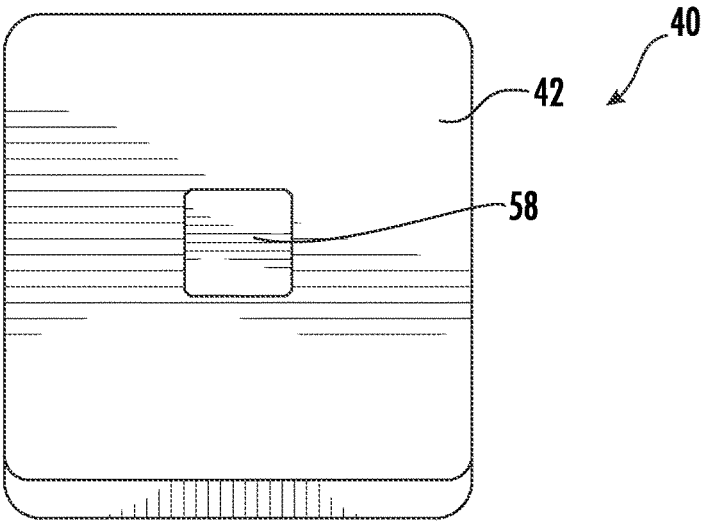
FIG. 4 is a rear view of the bracket of FIG. 1.
Figure 5:
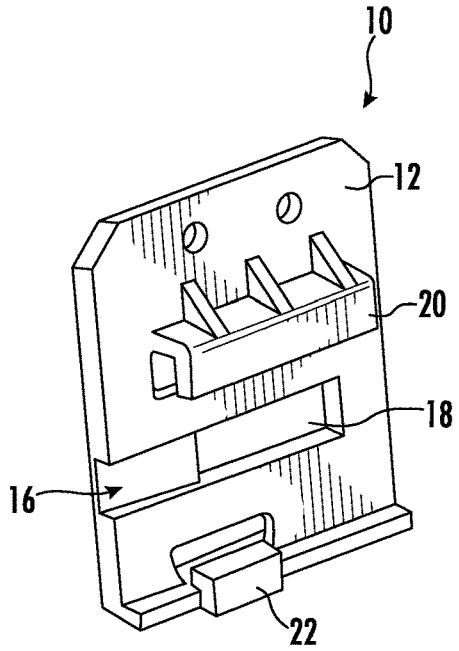
FIG. 5 (PRIOR ART)
FIG. 5 is a front perspective view of a mounting bracket that can be used with the undermount slide bracket of FIG. 1.

As seen in FIGS. 1 and 2, a lower stop 60 is present in each of the gaps 49 between the lower and intermediate wings 48, 50. An upper stop 62 is present in each of the gaps 51 between the intermediate and upper wings 50, 52. Notably, the upper stops 62 are not directly above the lower stops 60, but instead are, in the illustrated embodiment, positioned farther rearwardly (i.e., nearer the lower panel 45) than the stops 60. Also, in the illustrated embodiment, the stops 60, 62 extend from their respective foundations 53, 55 all the way to the edges of the wings 48, 50, 52.

The undermount slide bracket 40 is typically of unitary construction, but may be formed of multiple components if desired. The undermount slide bracket 40 may be formed of any material suitable for the mounting of drawer slides; a polymeric material, such as acetal, is typically employed. The undermount drawer slide 40 is typically formed by injection molding.

The use of the undermount slide bracket 40 can be understood by reference to FIGS. 5-8. As described in detail in U.S. Pat. No. 8,911,037, supra, a mounting bracket 10 (shown in FIG. 5) includes a main panel 12. An L-shaped upper flange 20 projects from the front side of the main panel 12 and extends downwardly, and another L-shaped lower flange 22 projects from the front side of the main panel and extends upwardly. An access ramp 16 leads from one edge of the main panel 12 toward the center thereof. The access ramp 16 leads to a rectangular recess 18 that extends horizontally between the upper and lower flanges 20, 22. The inwardmost portion of the access ramp 16 juts forwardly (i.e., toward the front surface of the main panel 12), with the result that the recess is bounded on all sides: on three sides by the main panel 12, and on the fourth side by the inwardmost portion of the access ramp 16.

The back side of the main panel 12 may include features, such as split dowels, that enable the bracket 10 to be mounted to a rear cabinet wall 70. In other embodiments, holes in the main panel 12 may receive screws for mounting the bracket 10 to the wall 70.

The mounting bracket 10 is typically of unitary construction, but may be formed of multiple components if desired. The mounting bracket 10 may be formed of any material suitable for the mounting of drawer slides; a polymeric material, such as ABS, is typically employed.

Figure 6:
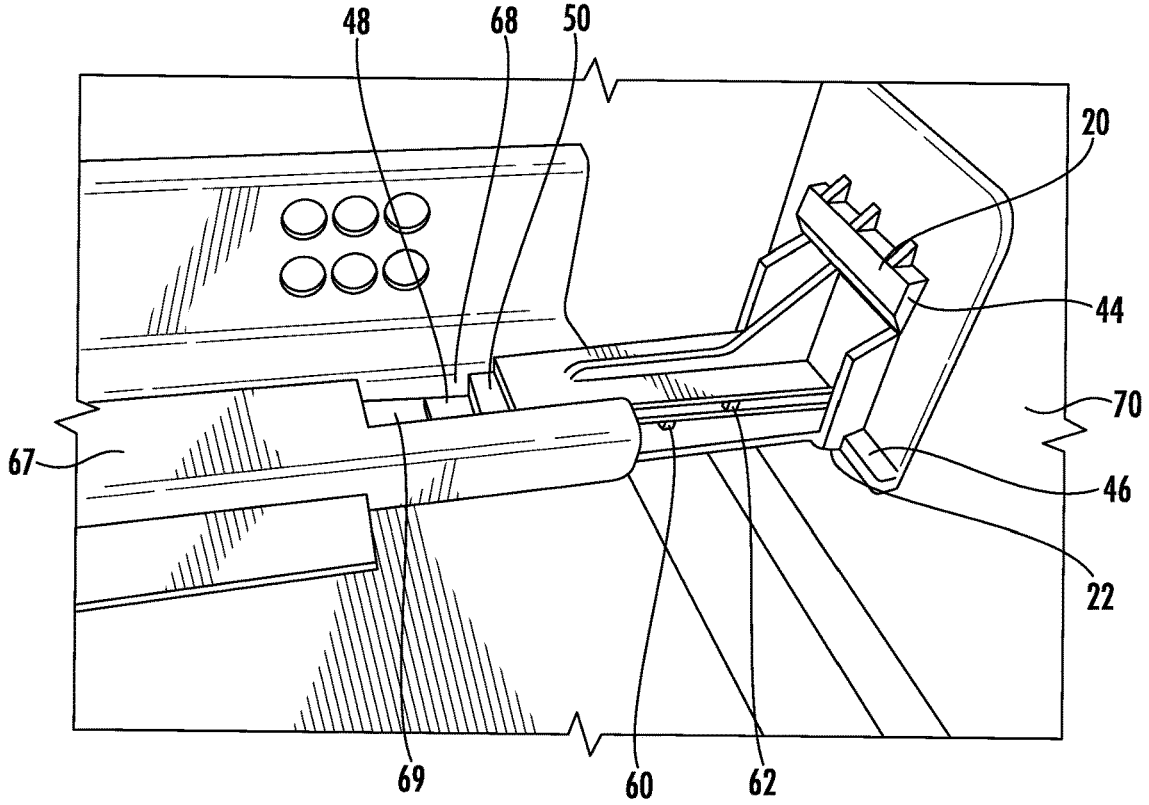
FIG. 6 is a front perspective view of the undermount slide bracket of FIG. 1 mounted on a bracket of FIG. 5, which is in turn mounted to the rear wall of a cabinet, wherein a drawer slide is being inserted into the lower gap of the undermount slide bracket.
Figure 7:
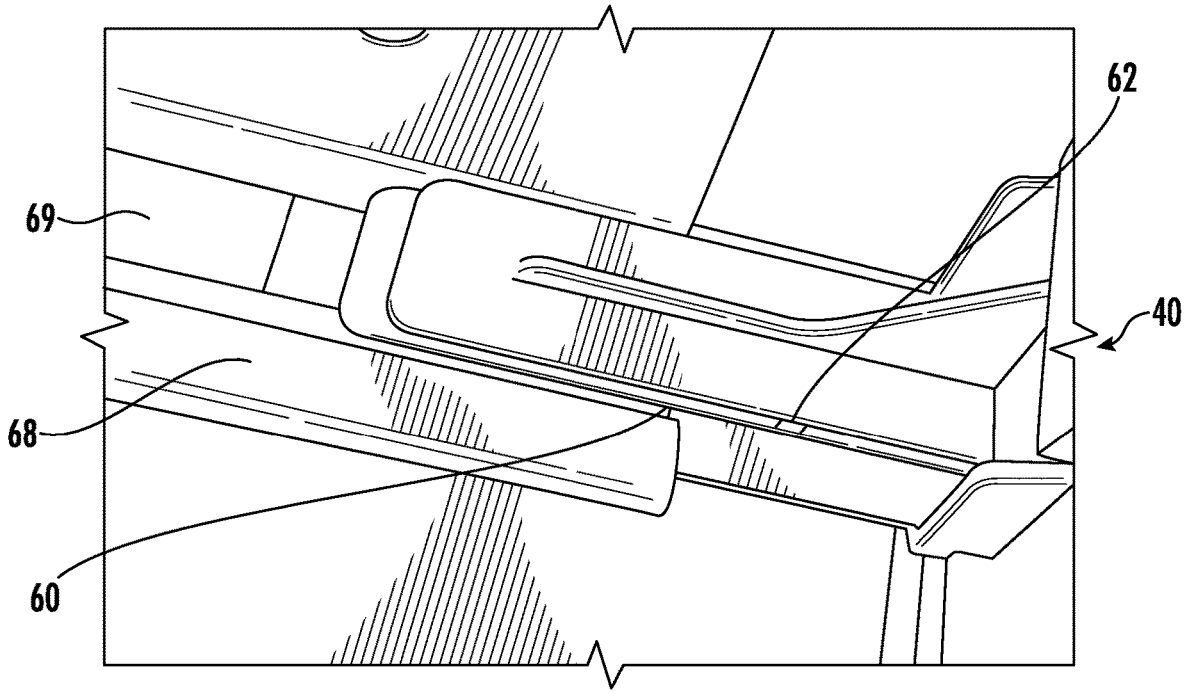
FIG. 7 is a top perspective view of the components shown in FIG. 6, wherein the drawer slide is fully inserted into the lower gap and engages the stop residing therein.
Figure 8:
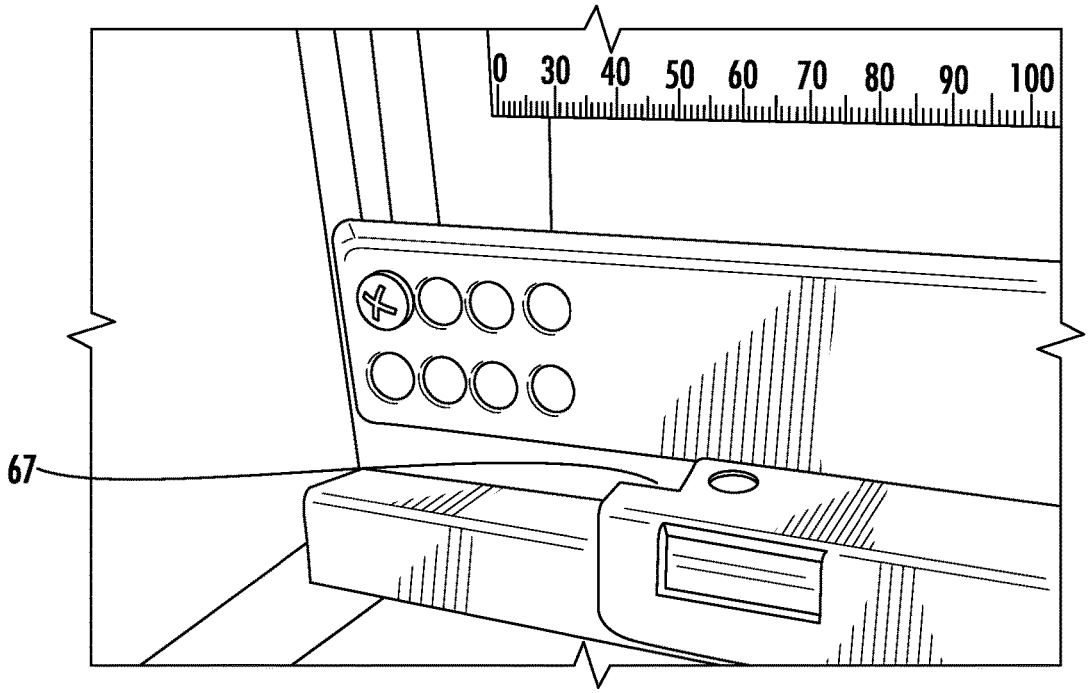
FIG. 8 is a side perspective view of the front end of the drawer slide shown in FIG. 7, mounted within the "window" of the front wall of a cabinet.

As can be seen in FIGS. 6 and 7, interconnection of the mounting bracket 10 and the undermount slide bracket 40 is accomplished by sliding the upper edge 44 of the vertical panel 42 into the pocket created by the upper flange 20, and by sliding the lower edge 46 of the vertical panel 42 into the pocket created by the lower flange 22 (FIG. 6). When so positioned, the rear nub 58 is received in the access ramp 16 in the main panel 12. The undermount slide bracket 40 is then slid toward the center of the mounting bracket 10 until the rear nub 58 is received in and captured by the rectangular recess. Once the nub 58 is positioned within the recess, the undermount slide bracket 40 is free to slide horizontally relative to the main panel 12 until the nub 58 strikes either of the side edges of the recess. Thus, the position of the undermount slide bracket 40 relative to the mounting bracket 10 can be adjusted.

Referring still to FIG. 6, once the mounting bracket 10 and undermount slide bracket 40 have been mounted to the cabinet wall 70 (typically by the manufacturer), a drawer slide 67 can be mounted to the undermount slide bracket 40.

Figure 9:
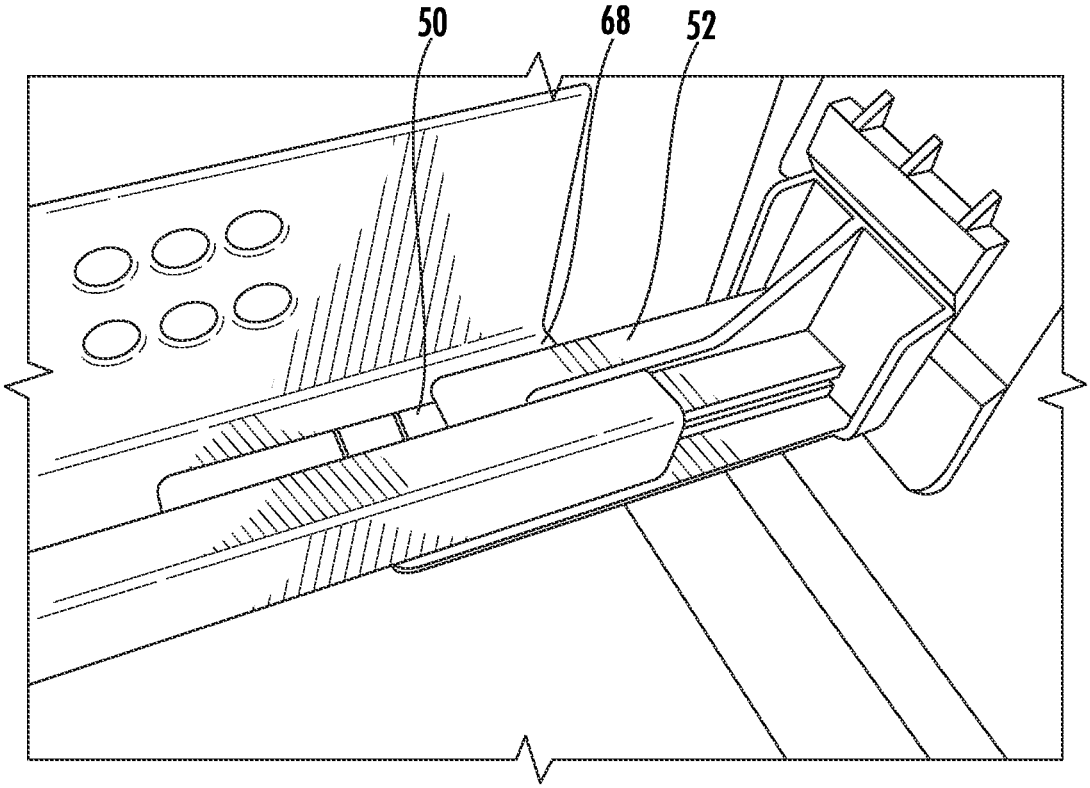
FIG. 9 is a front perspective view of the undermount slide bracket of FIG. 1 mounted on a bracket of FIG. 5, wherein a drawer slide is being inserted into the top gap of the undermount slide bracket.

Typically, the drawer slide 67 will not already be attached to the underside of a drawer, although this need not be the case. Mounting is achieved by sliding lips 68 that define a slot 69 in the drawer slides 67 into one of the set of the gaps 49, 51 between wings 48, 50, 52 of the undermount slide bracket 40 (FIG. 6 shows the lips 68 inserted into the lower gap 49, whereas FIG. 9 shows the lips inserted into the upper gap 51). Notably, because the undermount slide bracket 40 is free to slide horizontally relative to the mounting bracket 10, the horizontal position of the undermount slide bracket 40 can be adjusted so that the drawer slide 67 can be received more readily and easily even if the drawer slide 67 is already mounted to the drawer.

Because the stops 60, 62 are present between vertically adjacent wings 48, 50, 52, they can ensure that the slides 67 of the same drawer are positioned similarly within the undermount slide bracket 40. Also, the presence of the stops 60, 62 at the same location on each side of the undermount slide bracket 40 can ensure that each drawer slide 67 is oriented correctly relative to the undermount slide bracket 40 (i.e., the drawer slide 67 is not canted or tilted to the left or right) for proper mounting on the front of the cabinet.

In addition, the presence of the stops 60, 62 can provide an engagement surface within the gaps 49, 51 that, when the lips 68 engage the stops 60, 62, the stops provide a forwardly-directed pressure thereon. This pressure can assist in maintaining both the undermount slide bracket 40 in place relative to the bracket 10 and the drawer slide 67 in place relative to the undermount slide bracket 40. On some embodiments, the stops 60, 62 are located so that the drawer slides 67 extend into the gaps 49, 51 at least 50 percent of the length of the wings 48, 50, 52 from the lower panel 45 (in other words, at least 50 percent of the length of the pairs of wings that sandwich the drawer slide 67 engage the drawer slide 67).

Further, the relative positions of the stops 60, 62 can enable the same undermount slide bracket 40 to be employed with drawer slides of different sizes, and even from different manufacturers. This flexibility can enable cabinet manufacturers to use fewer different sizes of undermount slide brackets 40.

Further, although the stops 60, 62 are shown with the stops 60 being "forward" of the stops 62, in some embodiments these relative positions may be reversed. In other embodiments, one of the pairs of stops 60, 62 may be omitted. It should be noted that, if the undermount slide bracket 40 is injection molded, the positions of the stops 60, 62 may be changed by moving inserts within the mold, thereby enabling the production of a variety of brackets 40 with the same underlying base mold.

It should also be noted that the dimensions of the upper and lower edges 44, 46 of the undermount slide bracket 40, the upper and lower flanges 20, 22, and/or the nub 58 may be selected so that there is some frictional resistance to horizontal movement of the nub 58 within the recess 18. Such frictional resistance can limit unwanted horizontal movement, such that once the position of the undermount slide bracket 40 has been adjusted, the undermount slide bracket 40 remains in place and provides stable mounting to the drawer slide 67.

It should be noted that the bracket 10 may take a large variety of different configurations, particularly on the rear side of the main panel 12, that enable the bracket 10 of choice to used with a particular cabinet wall 70. Generally speaking, manufacturers of cabinets often employ several different hole patterns for mounting of the bracket 10. Virtually any of the brackets 10 that may be employed with such a cabinet may be used with the undermount slide brackets 40 described herein. As a result, "mixing and matching" of the combination of the brackets 10, the undermount slide brackets 40, and the drawer slides 67 is facilitated by the versatility of the undermount slide bracket 40.

As another potential advantage, in some embodiments only a single stop is included, and on only one side of the wings, and is positioned near the "entrance" of one of the gaps to indicate to the installer that it is the other gap that is to receive the drawer side.

It should also be noted that, although the undermount slide bracket 40 is illustrated herein, other varieties of undermount slide brackets that are suitable for mounting of undermount drawer slides may also be employed.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An undermount slide bracket, comprising:
- a panel with upper and lower edges;
- a nub extending from a first side of the panel;
- a shelf extending from a second, opposed side of the panel;
- a lower panel extending downwardly from the shelf;
- a plurality of pairs of wings extending from the lower panel, the pairs of wings being arranged in stacked, spaced apart relationship, such that a gap is formed between adjacent pairs of wings;
- at least one stop located in the gap between the wings.

2. The undermount slide bracket defined in claim 1, wherein the plurality of pairs of wings comprises at least three pairs of wings, and wherein the at least one stop is a plurality of stops, wherein one of the plurality of stops is located in each gap between each adjacent pair of wings.

3. The undermount slide bracket defined in claim 1, wherein the at least one stop is a plurality of stops, wherein a first of the stops is located a first distance from the lower panel, a second of the stops is located a second distance from the lower panel, and the second distance differs from the first distance.

4. The undermount slide bracket defined in claim 3, wherein the first stop is immediately above a lowermost pair of wings, and the second stop is immediately below an uppermost pair of wings.

5. The undermount slide bracket defined in claim 4, wherein the second distance is less than the first distance.

6. The undermount slide bracket defined in claim 1, wherein the undermount slide bracket is formed as a monolithic component.

7. The undermount slide bracket defined in claim 1, wherein the undermount slide bracket is formed of a polymeric material.

8. A bracket assembly for mounting a drawer slide in a cabinet, comprising:
- (a) a mounting bracket comprising:
- a main panel having front and rear surfaces, upper and lower edges, and opposed side edges;
- an L-shaped upper flange mounted to front surface of the main panel;

an L-shaped lower flange mounted to the front surface of the main panel substantially parallel to the upper flange;

a recess in the main panel positioned between the upper flange and the lower flange; and means for mounting the main panel to the cabinet wall so that the rear surface confronts the rear wall; and the undermount slide bracket defined in claim 1, wherein the upper edge of the undermount slide bracket panel is captured by the upper flange, the lower edge of the mating bracket panel is captured by the lower flange, and the nub is received in the recess;

wherein the recess and nub are configured such that the nub is free to translate horizontally within the recess relative to the main panel, such that the position of the mating bracket relative to the mounting bracket can be adjusted horizontally.

9. The bracket assembly defined in claim 8, wherein the plurality of pairs of wings comprises at least three pairs of wings, wherein the at least one stop is a plurality of stops, and wherein one stop of the plurality of stops is located in each gap between each adjacent pair of wings.

10. The bracket assembly defined in claim 8, wherein the at least one stop is a plurality of stops, wherein a first of the stops is located a first distance from the lower panel, a second of the stops is located a second distance from the lower panel, and the second distance differs from the first distance.

11. The bracket assembly defined in claim 10, wherein the first stop is immediately above a lowermost pair of wings, and the second stop is immediately below an uppermost pair of wings.

12. The bracket assembly defined in claim 11, wherein the second distance is less than the first distance.

13. The bracket assembly defined in claim 8, wherein the undermount slide bracket is formed as a monolithic component.

14. The bracket assembly defined in claim 8, wherein the undermount slide bracket is formed of a polymeric material.

15. The bracket assembly defined in claim 8, further comprising a drawer slide having lips that define a slot, and wherein the lips engage the at least one stop.

16. An undermount slide bracket, comprising:

a panel with upper and lower edges;

a nub extending from a first side of the panel;

a shelf extending from a second, opposed side of the panel;

a lower panel extending downwardly from the shelf;

first, second and third pairs of wings extending from the lower panel, the pairs of wings being arranged in stacked, spaced apart relationship, such that a gap is formed between adjacent pairs of wings;

a first stop located in the gap between the first and second pairs of wings; and a second stop located in the gap between the second and third pairs of wings.

17. The undermount slide bracket defined in claim 16, wherein the first stop is located a first distance from the lower panel, the second stop is located a second distance from the lower panel, and the second distance differs from the first distance.

18. The undermount drawer slide defined in claim 16, in combination with a drawer slide having lips that define a slot, and wherein the lips engage one of the first and second stops.

* * * * *